US008668387B2

(12) United States Patent
Ebner et al.

(10) Patent No.: US 8,668,387 B2
(45) Date of Patent: Mar. 11, 2014

(54) DEPLOYABLE FLUID COLLECTION BAG AND METHOD OF FORMING THE SAME

(76) Inventors: Emmett J. Ebner, Santa Ana, CA (US); Brian J. Huffer, Santa Ana, CA (US)

( * ) Notice: Subject to any disclaimer, the term of this patent is extended or adjusted under 35 U.S.C. 154(b) by 255 days.

(21) Appl. No.: 13/169,819

(22) Filed: Jun. 27, 2011

(65) Prior Publication Data

US 2012/0230611 A1 Sep. 13, 2012

Related U.S. Application Data

(63) Continuation-in-part of application No. 13/044,163, filed on Mar. 9, 2011, now Pat. No. 8,550,712.

(51) Int. Cl.

| | |
|---|---|
| ***B65D 33/10*** | (2006.01) |
| ***B65D 30/16*** | (2006.01) |
| ***B65D 30/00*** | (2006.01) |
| ***B65D 30/18*** | (2006.01) |

(52) U.S. Cl.
USPC ..... 383/10; 383/104; 383/108; 383/122

(58) Field of Classification Search
USPC ..... 383/8, 9, 10, 16, 77, 121, 122, 107, 383/108, 104, 110, 120
See application file for complete search history.

(56) References Cited

U.S. PATENT DOCUMENTS

| | | | | |
|---|---|---|---|---|
| 1,341,404 A | | 5/1920 | Wisniewska | |
| 1,876,982 A | | 9/1932 | Lichter | |
| 2,532,778 A | | 12/1950 | Mintzes | |
| 3,938,731 A | * | 2/1976 | Ross et al. | 383/10 |
| 4,041,851 A | | 8/1977 | Jentsch | |
| 4,154,323 A | | 5/1979 | Sneider | |
| 4,221,321 A | * | 9/1980 | Langen et al. | 383/10 |
| 4,244,408 A | * | 1/1981 | Shoda | 383/2 |
| 4,679,242 A | | 7/1987 | Brockhaus | |
| 4,890,934 A | * | 1/1990 | Feaver et al. | 383/10 |
| D309,565 S | * | 7/1990 | Newman et al. | D9/704 |
| 5,165,799 A | * | 11/1992 | Wood | 383/8 |
| 6,068,402 A | | 5/2000 | Freese et al. | |
| 7,866,473 B2 | * | 1/2011 | Clark et al. | 206/494 |

FOREIGN PATENT DOCUMENTS

| | | | | |
|---|---|---|---|---|
| FR | 2676989 A1 | * | 12/1992 | A01K 1/015 |
| JP | 03133746 A | | 6/1991 | |

OTHER PUBLICATIONS

Bagster Bag Products Specs. Copyright 2010 Waste Management. http://www.thebagster.com/product_info_specs.aspx.

* cited by examiner

*Primary Examiner* — Jes F Pascua
(74) *Attorney, Agent, or Firm* — Stetina Brunda Garred & Brucker

(57) ABSTRACT

Provided is a deployable, foldable fluid collection bag which may be selectively deployed as desired by the user. The bag may be configured to fit in tight spaces and be deployed to collect fluid which leaks during plumbing repairs and installations. The bag may be fabricated from a unitary piece of material and include a base, a first panel and a second panel. The first panel may be coupled to the end portions of the base and to the second panel to define a pair of opposed sidewalls and a pair of opposed end walls.

8 Claims, 4 Drawing Sheets

DEPLOYABLE FLUID COLLECTION BAG AND METHOD OF FORMING THE SAME

CROSS-REFERENCE TO RELATED APPLICATIONS

This application is a continuation-in-part of prior application Ser. No. 13/044,163, filed Mar. 9, 2011 now U.S. Pat. No. 8,550,712.

STATEMENT RE: FEDERALLY SPONSORED RESEARCH/DEVELOPMENT (Not Applicable)

BACKGROUND OF THE INVENTION

1. Field of the Invention

The present invention relates generally to a fluid collection device, and more specifically, to a deployable, flexible fluid collection bag and a method of forming the same.

2. Description of the Related Art

It is very common for a drain connected to a kitchen sink to become blocked, or for a waste disposal unit to become inoperable. Repair of the kitchen sink or the waste disposal typically requires removal of at least a portion of the plumbing line running to the kitchen sink, or disconnection of the waste disposal from the plumbing lines. Although the water line may be turned off, water or fluid already present in the plumbing lines may leak or flow out when such repairs are performed. As can be appreciated, it is undesirable to allow the fluid to leak into the space under the kitchen sink. Therefore, various receptacles are typically placed under the leak to catch the fluid.

Due to the cramped space and plumbing lines extending under the kitchen sink, conventional buckets and pails may not easily fit within the space under the sink to catch the fluid. Thus, various supplies commonly found in the kitchen, such as pots, pans, cookie sheets, etc. are oftentimes employed as fluid collection devices to collect the fluid as it leaks from the plumbing.

Given that the aforementioned kitchen supplies are not specifically tailored for such use, it can be appreciated that there are several deficiencies associated therewith. One problem is that the supplies may not be able to effectively collect the fluid as it leaks. For instance, a cookie sheet is very shallow and may not have enough fluid capacity to collect all of the leaking fluid, or the fluid may splash outside of the cookie sheet as it leaks out.

Another problem associated with conventional kitchen supplies is that they are generally rigid in nature. More specifically, pots, pans, and cookie sheets are typically formed from cast metal, such as stainless steel, copper, etc. and do not offer much flexibility when being placed in cramped quarters, such as under the kitchen sink. In this regard, they may not be able to fit around many of the pipes or other plumbing fixtures disposed under this sink.

In addition, although fluid leaking from kitchen sink repairs may be relative clean in most cases, it is also possible that the fluid may have particulate suspended therein (i.e., dirty water). Furthermore, other plumbing repairs may produce leakage of dirty fluid. An exemplary repair associated with dirty fluids is replacement of a toilet. In such a repair, sewage may leak from the toilet as it is removed from the floor. Therefore, it is desirable to collect the leaking fluid within a container which is disposable to allow the dirty fluid to be easily disposed of. Moreover, if certain plumbing fixtures or accessories are removed containing the dirty fluid, it is desirable to transport such fixtures and accessories within a receptacle that would mitigate further leakage of the dirty fluid.

As is apparent from the foregoing, there exists a need in the art for a deployable fluid collection bag and a method of forming the same, wherein the bag can be deployed during conventional plumbing repairs to collect fluid and to facilitate transport of the fluid for disposal. The present invention addresses this particular need, as will be discussed in more detail below.

BRIEF SUMMARY OF THE INVENTION

According to an aspect of the present invention, there is provided a deployable, foldable fluid collection bag which may be selectively deployed as desired by the user. The bag may be configured to fit in tight spaces and be deployed to collect fluid which leaks during plumbing repairs and installations. The bag is also flexible to enable bending or folding around plumbing lines and fixtures when placing the bag under the leak. Furthermore, the bag may also define an internal stiffness or rigidity suitable to allow the bag to remain upright when deployed to contain the fluid capture within the bag.

According to one embodiment, the bag includes a base wall defining a pair of opposed end edges and a pair of opposed lateral portions extending between the pair of opposed end edges. A first panel is integrally coupled to the base wall adjacent a respective one of the pair of opposed lateral portions. The first panel includes a first sidewall and a pair of first end portions integrally formed with the first sidewall and disposed on opposed ends of the first sidewall. Each first end portion defines a first base edge and a first end edge. Each first base edge is coupled to a respective one of the pair of opposed end edges to form a fluid-tight seal between the base wall and the pair of first end portions. A second panel is integrally coupled to the base wall adjacent a respective one of the pair of opposed lateral portions. The second panel includes a second sidewall and a pair of second end portions disposed on opposed ends of the second sidewall. Each second end portion defines a second base edge and a second end edge. Each second base edge is coupled to a respective one of the pair of opposed end edges to form a fluid-tight seal between the base wall and the pair of second end portions. Each second end edge is coupled to a respective first end edge to form a fluid tight seal between respective ones of the pair of first end portions and the pair of second end portions.

The bag may be formed from a single sheet of material to facilitate manufacture of the bag and to enable mass production of the bag at an economical cost.

According to another aspect of the present invention, there is additionally provided a method of forming a deployable fluid collection bag. The method includes the step of providing a single sheet of material configured to include a base wall defining a pair of opposed end edges and a pair of opposed lateral portions extending between the pair of opposed end edges. The single sheet of material additionally includes a first panel integrally coupled to the base wall adjacent a respective one of the pair of opposed lateral portions. The first panel includes a first sidewall and a pair of first end portions integrally formed with the first sidewall and disposed on opposed ends of the first sidewall. Each first end portion defines a first base edge and a first end edge. A second panel is integrally coupled to the base wall adjacent a respective one of the pair of opposed lateral portions. The second panel includes a second sidewall and a pair of second end portions disposed on opposed ends of the second sidewall, wherein each second end portion defines a second base edge and a second end edge. The method further includes the step of connecting the first base edge to respective ones of the pair of opposed end edges to create a fluid-tight seal between the pair of first end portions and the base wall. The second base edges are then connected to respective ones of the pair of opposed end edges to create a fluid-tight seal between the pair of second end portions and the base wall. The first end edge is then connected to a respective second end edge to join each first end portion to a respective one of the second end portions and to form a fluid tight seal therebetween.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION OF THE INVENTION

Figure 1:
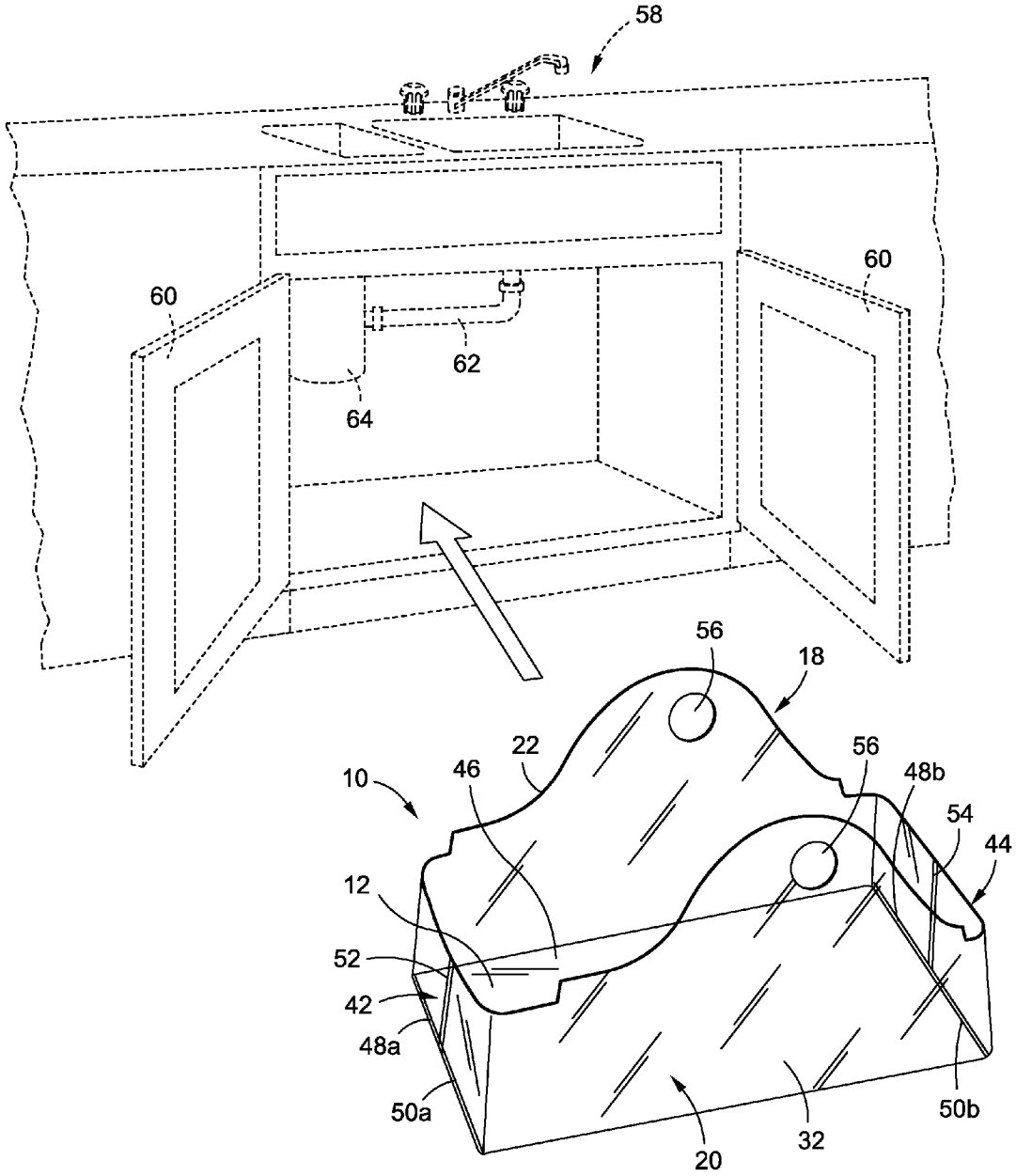
FIG. 1 is an upper perspective view of a deployable fluid collection bag configured for use for use in performing plumbing repairs, such as repairing kitchen plumbing, wherein the kitchen sink is shown in phantom.
Figure 2:
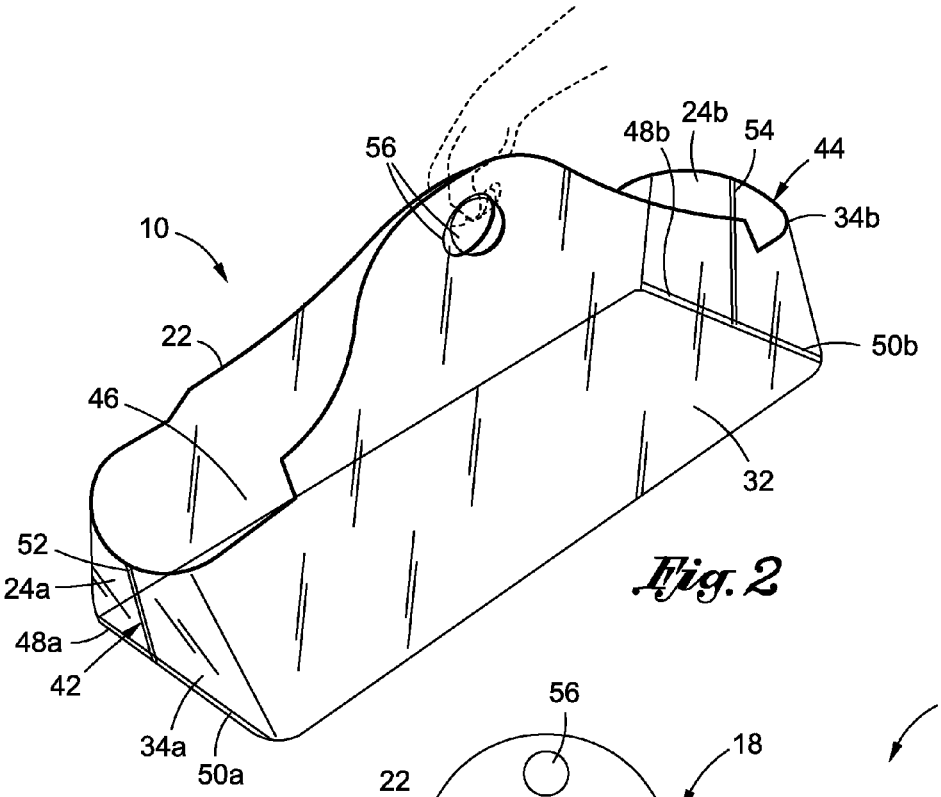
FIG. 2 is an upper perspective view of the fluid collection bag with a user gripping the bag by a pair of handles.
Figure 3:
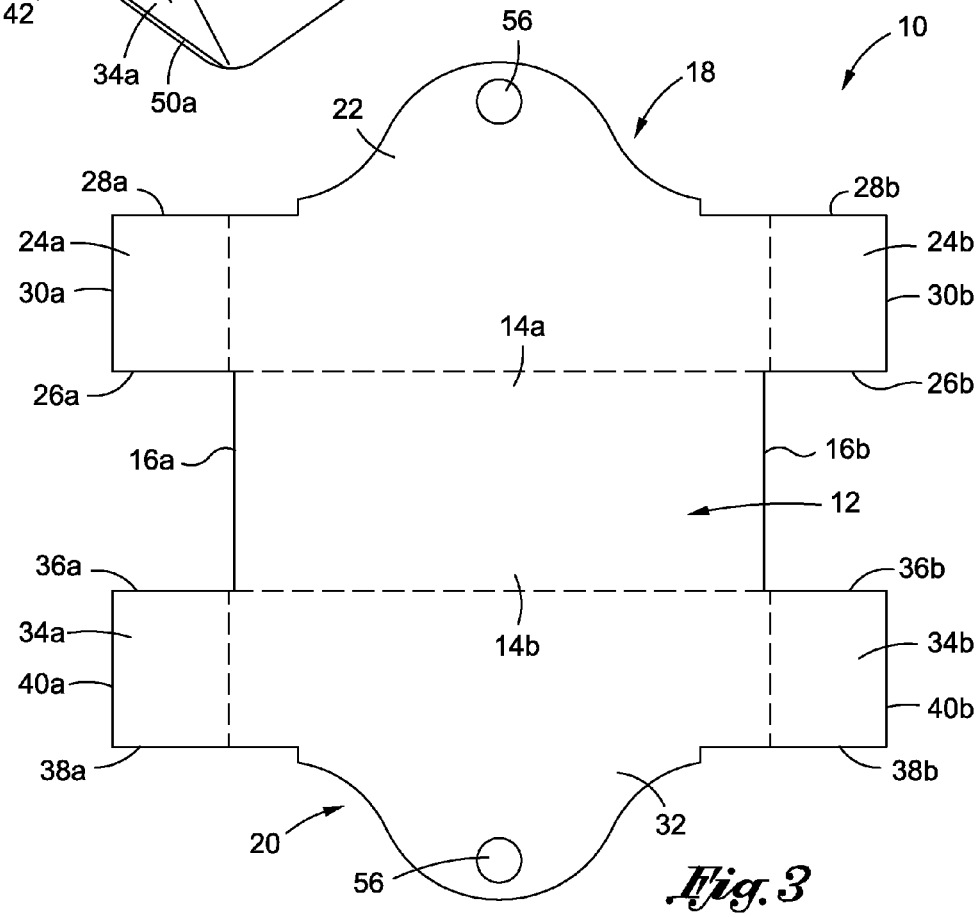
FIG. 3 is a top plan view of the fluid collection bag in an unassembled configuration.

Referring now to the drawings wherein the showings are for purposes of illustrating a preferred embodiment of the present invention only, and not for purposes of limiting the same, FIGS. 1-3 illustrate one embodiment of a deployable, foldable fluid collection bag 10 sized and configured to allow the bag 10 to be easily deployed to collect fluid while performing plumbing repairs, remodels, or installations, such as repairs under a kitchen sink. According to one implementation, the bag 10 employs a unique design which allows the bag 10 to be formed from a single piece of material to simplify manufacturing of the bag 10, thereby enabling mass production thereof at an economical cost. The single-piece construction also enhances the fluid-tight nature of the bag 10 by reducing the number of seams or junctions needed to form the bag 10, particularly along the bottom of the bag 10, which is the first area to be filled and would have the greatest load applied by the fluid collected in the bag 10. The bag 10 is also flexible to allow the bag 10 to be deployed in tight spaces.

FIGS. 1 and 2 show the bag 10 in an assembled configuration, while FIG. 3 shows the bag 10 in an unassembled configuration. The bag 10 includes a base wall 12 defining a pair of opposed lateral portions 14*a*, 14*b*, and a pair of opposed end edges 16*a*, 16*b*. The base wall 12 shown in FIG. 3 defines a generally quadrangular shape with the pair of opposed lateral portions 14*a*, 14*b* being generally parallel to each other and defining a length that is longer than the pair of opposed end edges 16*a*, 16*b*, which also extend generally parallel to each other.

The bag 10 additionally includes a first panel 18 and a second panel 20 connected to the base wall 12. The first panel 18 and the second panel 20 are preferably integrally formed with respective ones of the pair of laterals portions 14*a*, 14*b* of the base wall 12. The first panel 18 includes a first sidewall 22 and a pair of opposed tabs or first end portions 24*a*, 24*b* integrally formed with the first sidewall 22. The first sidewall 22 is integrally formed with the lateral portion 14*a*. Each first end portion 24*a*, 24*b* includes a first base edge 26*a*, 26*b*, a first upper edge 28*a*, 28*b*, and a first end edge 30*a*, 30*b* extending between the first base edge 26*a*, 26*b* and the first upper edge 28*a*, 28*b*. The first base edge 26*a*, 26*b* and the first upper edge 28*a*, 28*b* are disposed in generally parallel relation to each other, with the first end edge 30*a*, 30*b* being generally orthogonal to the first upper edge 28*a*, 28*b* and the first base edge 26*a*, 26*b*.

The second panel 20 is similar to the first panel 18 in that it includes a second sidewall 32 and a pair of opposed tabs or second end portions 34*a*, 34*b* integrally formed with the second sidewall 32. The second sidewall 32 is integrally coupled to the lateral portion 14*b* of the base wall 12. Each second end portion 34*a*, 34*b* includes a second base edge 36*a*, 36*b*, and second upper edge 38*a*, 38*b* and a second end edge 40*a*, 40*b* extending between the second base edge 36*a*, 36*b* and the second upper edge 38*a*, 38*b*. The second base edge 36*a*, 36*b* and the second upper edge 38*a*, 38*b* are disposed in generally parallel relation to each other, with the second end edge 40*a*, 40*b* being generally orthogonal to the second upper edge 38*a*, 38*b* and the second base edge 36*a*, 36*b*.

With the basic structural features of the bag 10 described above, the following discussion pertains to the method of constructing the bag 10. Referring first to FIG. 3, the bag 10 is formed from a single sheet of material. The bag 10 is preferably formed from a plastic material, such as 6 ml polyethylene or 5 ml polypropylene, however, other materials or thicknesses may be used without departing from the spirit and scope of the present invention. The bag 10 is cut, stamped, or otherwise removed from the sheet of material to include the base wall 12, first panel 18 and second panel 20, as described above.

After the bag 10 has been removed from the sheet of material, it is folded toward its assembled configuration, as shown in FIGS. 1 and 2, to include a pair of sidewalls 22, 32 and a pair of end walls 42, 44 extending from the base wall 12 to define a cavity 46 (see FIG. 2). More specifically, the pair of sidewalls 22, 32 are formed by folding the first panel 18 and second panel 20 toward an upright configuration relative to the base wall 12. When the first panel 18 is in its upright configuration, the first end edge 30 may be folded relative to the first sidewall 22 to align the first base edge 26 with a respective one of the base wall end edges 16*a*, 16*b*. The first base edge 26*a* and the base wall end edge 16*a* are then connected to form a fluid tight seal between the first end portion 24*a* and the base wall 12. This procedure is repeated to connect the first end portion 24*b* to the base wall 12.

When the second panel 20 is in its upright configuration, the second end portion 34*a* may be folded relative to the second sidewall 32 to align the second base edge 36*a* with the base wall end edge 16*a*. The second base edge 36*a* and the base wall end edge 16*a* are then connected to form a fluid tight seal between the second end portion 34*a* and the base wall 12. This procedure is repeated to connect the second end portion 34*b* to the base wall 12.

The end walls 42, 44 are formed by joining the each first end portion 24*a*, 24*b* with the adjacent and corresponding second end portion 34*a*, 34*b*. In particular, first end portion 24*a* is connected to second end portion 34*a* to form end wall 42, while first end portion 24*b* is connected to second end portion 34*b* to form end wall 44. The first end edge 30*a* is joined to second end edge 40*a* to form end wall 42, and first end edge 30 is joined to second end edge 40*b* to form end wall 44.

According to one embodiment, the first end portions 24*a*, 24*b* are joined to the base wall 12 by fluid tight seams 48*a*, 48*b* and the second end portion 34*a*, 34*b* are joined to the base wall 12 via a fluid tight seams 50*a*, 50*b* (see FIG. 2). Likewise, the first end portions 24*a*, 24*b* may be joined to the second end portions 34*a*, 34*b* by fluid tight seams 52, 54. The seams may be formed by welding, adhesives, or other common seaming techniques known by those skilled in the art.

The configuration of the bag 10 advantageously minimizes the number of seams and places the seams at the outer portions of the bag 10, i.e., adjacent and along the end walls 42, 44, while at the same time allowing the bag 10 to be formed from a single piece of material. The configuration of the bag 10 additionally allows the base wall 12 to be formed from a continuous piece of material, i.e., formed independent of a seam, which may otherwise compromise the structural integrity of the base wall 12. Along these lines, the load of the fluid captured within the bag 10 is primarily applied to the base wall 12. Therefore, by configuring the bag 10 such that the seams are not located within the base wall 12, the strength of the bag 10 is enhanced.

One embodiment of the bag 10 may include a pair of handles 56 to allow the bag 10 to be easily clutched by the user. In the embodiment shown in FIGS. 1-3, the handles 56 are formed within the first and second sidewalls 22, 32 at a location near the longitudinal midpoint of the bag 10. The first and second sidewalls 22, 32 may extend above the upper edges of the end walls 42, 44, and the handles 56 may be formed near the upper edges of the first and second sidewalls 22, 32 to facilitate clutching of the bag 10.

Referring now specifically to FIG. 3, the handles 56 may be formed within the first and second sidewalls 22, 32 while the bag 10 is in the unassembled configuration. More specifically, the apertures which define the handles 56 may be cut or punched through the sheet of material prior to folding the bag 10 into the assembled configuration. The handles 56 may be positioned along the first and second sidewalls 22, 32 such that when a user brings the first and second sidewalls 22, 32 together, as shown in FIG. 2, the handles 56 are aligned to allow the user's hand to easily grasp both handles 56.

In use, the bag 10 may be easily deployed when performing plumbing repairs or installations to collect leaking fluid. Prior to use, the bag 10 may be in a folded configuration, wherein the pair of sidewalls 22, 32 and the pair of end walls 42, 44 are folded onto the base wall 12. The bag 10 may then be unfolded or deployed to define a cavity 46 for catching the leaking fluid. The foldable nature of the bag 10 may allow the bag 10 to be used in tight spaces, as is commonly the case during plumbing repairs. For instance, the bag 10 shown in FIG. 1 is configured for use during a plumbing repair or installation under the kitchen sink 58, which is shown in phantom. The kitchen includes a pair of cabinet doors 60 which provide access to the space under the sink 58 and to the plumbing line 62 and a waste disposal unit 64. The bag 10 may be bent and folded to pass under and around the plumbing line 62 and the waste disposal unit 64 to position the bag 10 such that during the repair, any fluid that may leak may be caught within the bag 10. Along these lines, the bag 10 may define enough internal stiffness and rigidity to maintain the sidewalls 22, 32 and end walls 42, 44 in a generally upright configuration to catch the fluid, and to contain the fluid within the bag 10. In other words, the weight of the fluid should not cause the sidewalls 22, 32, and end walls 42, 44 to collapse.

Once the repairs or installation are complete, the user may grasp the handles 56 to remove the bag 10 from the kitchen compartment. It is contemplated that the bag 10 may be disposable to allow the user to easily dispose of the bag 10 and the collected fluid. However, it is also contemplated that the user may simply pour out the collected fluid to allow the bag 10 to be reused.

Although the foregoing describes the bag 10 as being usable during kitchen plumbing repairs, those skilled in the art will appreciate that the bag 10 may also be used in relation to other plumbing procedures. For instance, the bag 10 may be used in connection with replacement of a toilet. In particular, the toilet being removed and replaced may be placed within the bag 10 after it is removed from the floor of the bathroom. The bag 10 may be used to transport the toilet from the bathroom during disposal of the toilet to catch any fluid or sewage that may be present in the toilet.

It is contemplated that the uses of the bag 10 discussed herein and shown in the Figures are exemplary in nature only and are not intended to limit the scope of the present invention. Along these lines, those skilled in the art may contemplate other uses of the bag 10 which are not discussed or shown herein.

Figure 4:
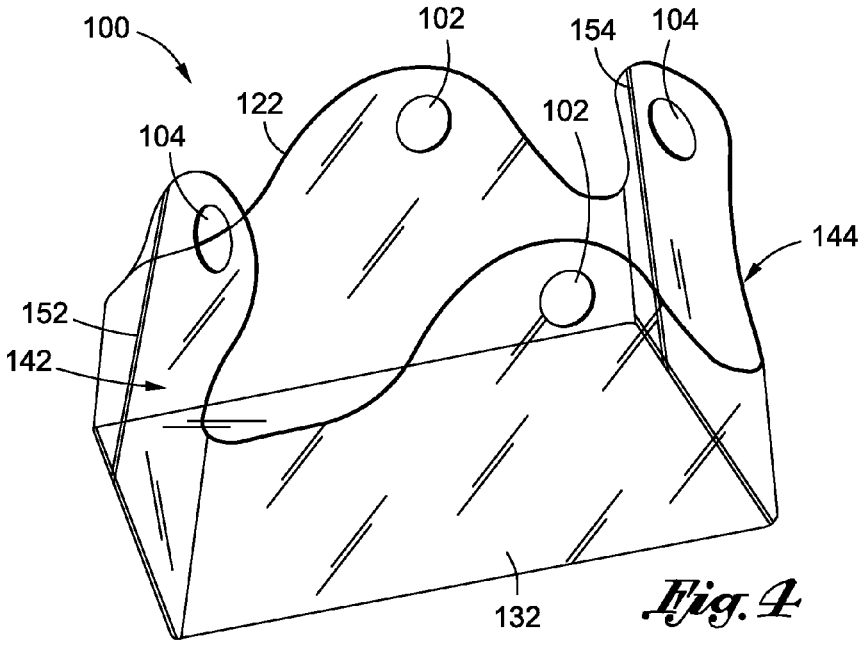
FIG. 4 is an upper perspective view of a second embodiment of a fluid collection bag having two pairs of handles.
Figure 5:
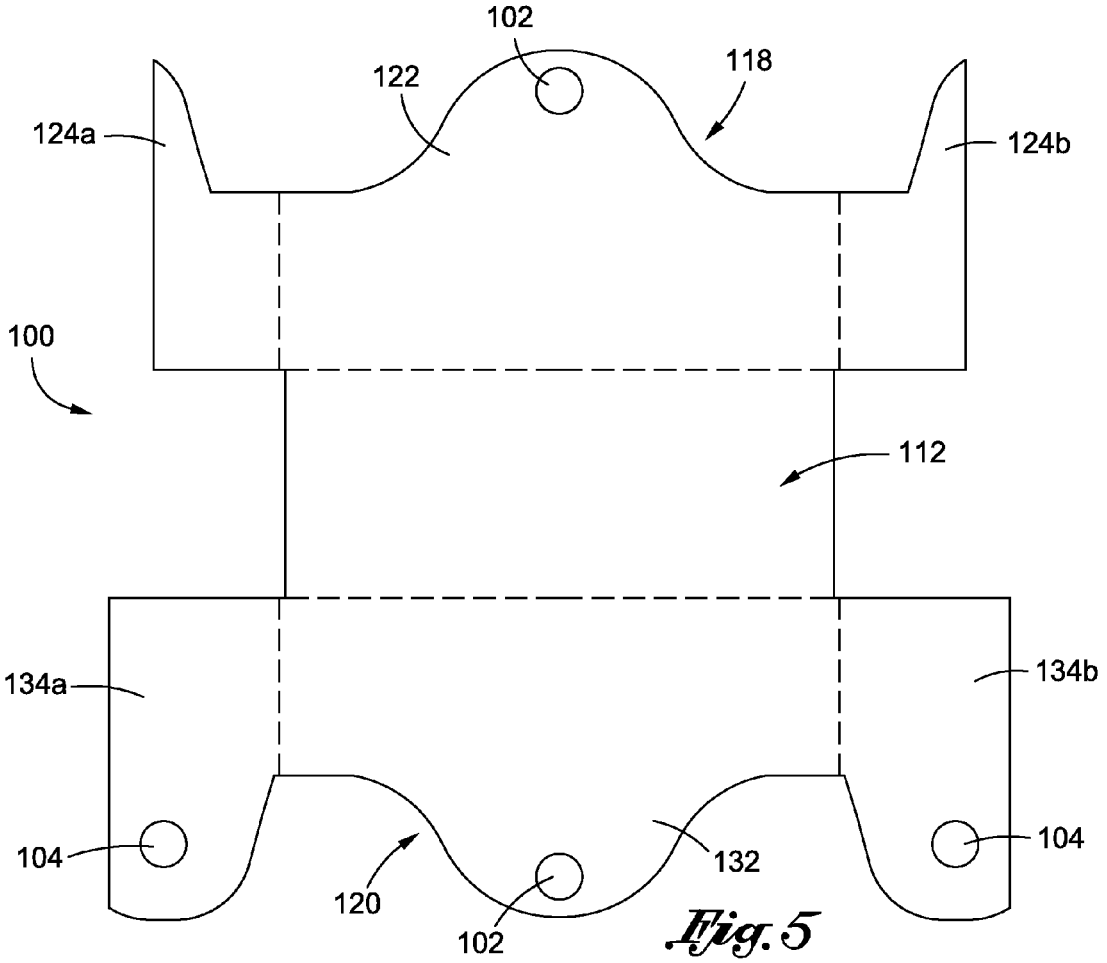
FIG. 5 is a top plan view of the second embodiment of the bag in an unassembled configuration.

Referring now specifically to FIGS. 4 and 5, there is shown a second embodiment of the bag 100. The primary distinction between the bag 100 shown in FIGS. 4 and 5, and the bag 10 shown in FIGS. 1-3 is that the bag 100 includes two pairs of handles, specifically, one pair of handles 102 formed in the sidewalls 122, 132 and another pair of handles 104 formed in the end walls 142, 144.

The bag 100 includes a base wall 112, a first panel 118 and a second panel 120. The first panel 118 defines a first sidewall 122 and a pair of opposed first end portions 124*a*, 124*b*, while the second panel 120 defines a second sidewall 132 and a pair of opposed second end portions 134*a*, 134*b*. The first end portions 124*a*, 124*b* are different from the second end portions 134*a*, 134*b* in order to accommodate the handles 104 and the seams 152, 154 which joins the first end portion 124*a*, 124*b* to the second end portions 134*a*, 134*b*. In particular, it is desirable to form the handles 104 within each end wall 142, 144 near the latitudinal midpoint of the bag 100. Furthermore, the seams 152, 154 are preferably spaced from the respective handles 104 to allow the seams 152, 154 to extend continuously along the respective end wall 142, 144, i.e., the seams 152, 154 are not broken or interrupted by the handle 104. Therefore, in the embodiment depicted in FIGS. 4 and 5, the pair of second end portions 134*a*, 134*b* is slightly larger than the pair of first end portions 124*a*, 124*b* to allow the handles 104 to be formed completely within the second end portions 134*a*, 134*b*. Furthermore, the first end portions 124*a*, 124*b* and second end portions 134*a*, 134*b* are configured to collectively define the end walls 142, 144 when the first end portions 124*a*, 124*b* are seamed to the second end portions 134*a*, 134*b*.

Although the embodiment shown in FIGS. 4 and 5 include the handles 104 formed within the second end portions 134*a*, 134*b*, it is understood that the handles 104 may be formed in the first end portions 124*a*, 124*b* without departing from the spirit and scope of the present invention. Furthermore, those skilled in the art will appreciate that forming the bag 100 with the handles 104 spaced from the seams is only a preferred embodiment, and that other embodiments may include a seam which passes through the handle 104 (as will be described in more detail below), or a seam that is curved to extend around the handle 104.

The bag 100 shown in FIGS. 4 and 5 is constructed in a manner similar to the bag 10 discussed above and shown in FIGS. 1-3. In particular, the bag 100 is preferably formed from a single sheet of material, wherein the base wall 112, first panel 118 and second panel 120 are cut from the sheet of material. The first and second panels 118, 120 and then folded relative to the base wall 120 to allow the first end portions 124*a*, 124*b* and the second end portions 134*a*, 134*b* to be seamed to the base wall 112, and then to each other.

Figure 6:
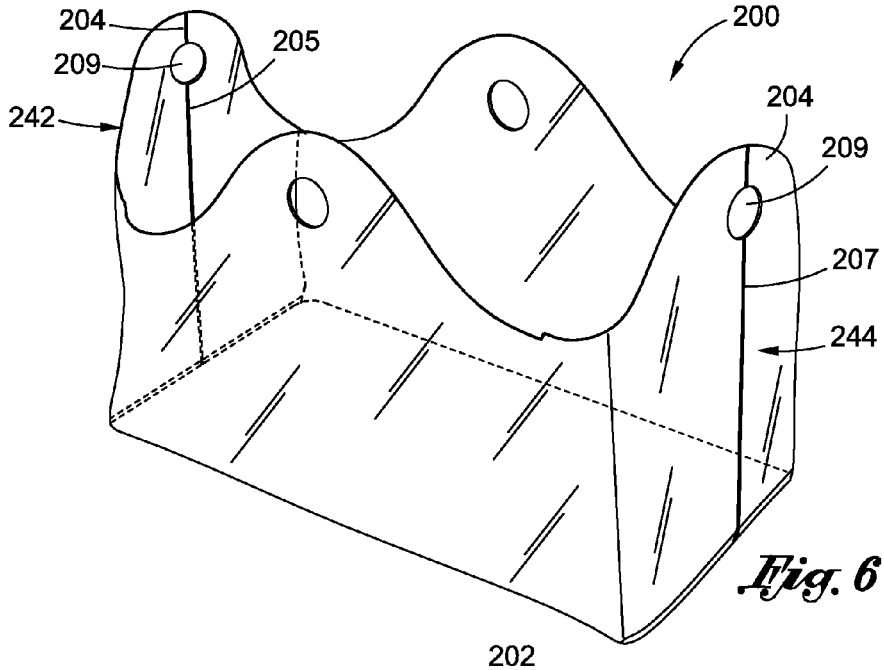
FIG. 6 is an upper perspective view of a third embodiment of a fluid collection bag having a seam that extends through a handle opening.
Figure 7:
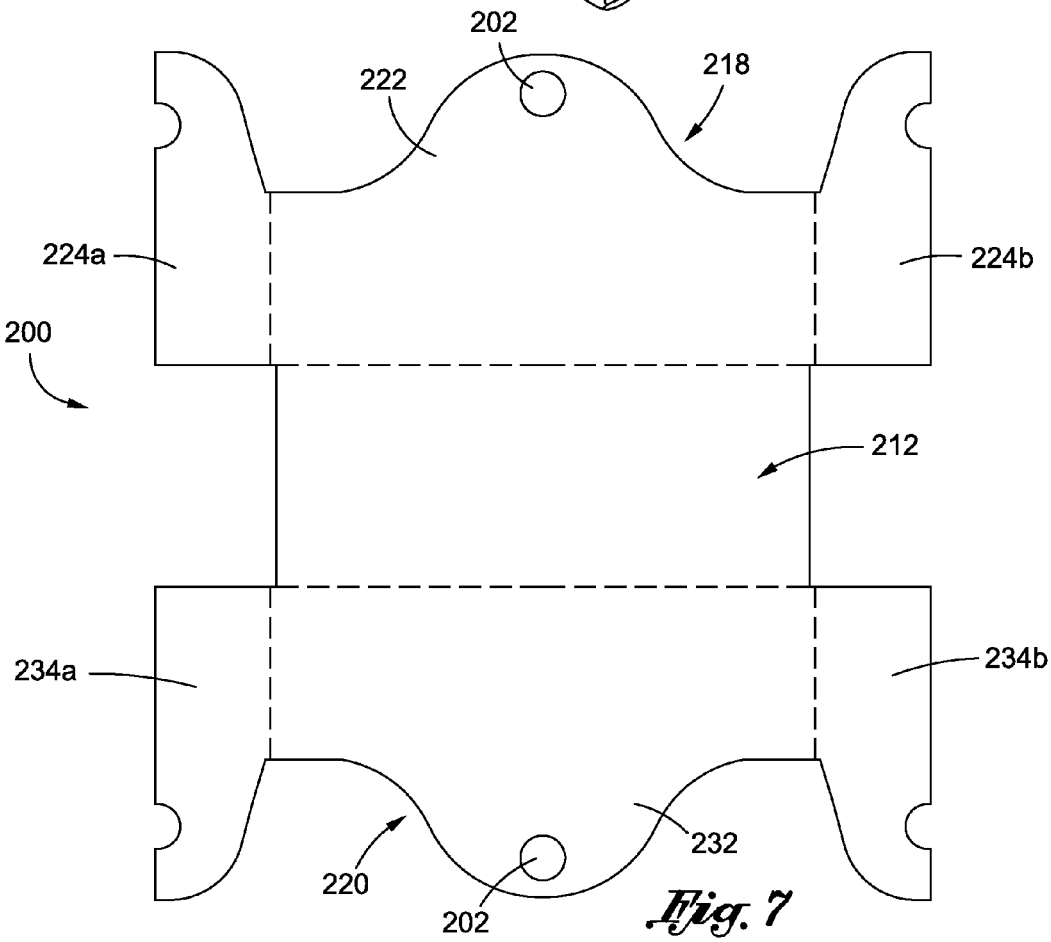
FIG. 7 is a top plan view of the third embodiment of the bag in an unassembled configuration.

Referring now specifically to FIGS. 6 and 7, there is shown a third embodiment of the bag 200. The bag 200 is similar to the bag 100 shown in FIGS. 4 and 5, with the primary distinction being the position of the seams 205, 207. As will be explained in more detail below, the bag 200 includes seams 205, 207 that are disposed midway along the width of the bag 200 and through a handle opening 209, as opposed to being offset from the midsection and from the handle opening 209, as is shown in relation to the bag 100.

The bag 200 includes a base wall 212, a first panel 218 and a second panel 220. The first panel 218 defines a first sidewall 222 and a pair of opposed first end portions 224*a*, 224*b*, while the second panel 220 defines a second sidewall 232 and a pair of opposed second end portions 234*a*, 234*b*. The size and shape of the first end portions 224*a*, 224*b* are substantially similar to the size and shape of the second end portions 234*a*, 234*b*. Seam 205 is formed at the junction of the first end portion 224*a* to the second end portion 234*a* and seam 207 is formed at the junction of the first end portion 224*b* and the second end portion 234*b*.

Handles 204 may be formed within each end wall 242, 244 near the latitudinal midpoint of the bag 200. Furthermore, the seams 205, 207 extend along an axis that intersects the respective handles 204. This may result in a more symmetrical design (See FIG. 7) to facilitate construction and assembly of the bag 200. The first end portions 224*a*, 224*b* and second end portions 234*a*, 234*b* are configured to collectively define the end walls 242, 244 when the first end portions 224*a*, 224*b* are seamed to the second end portions 234*a*, 234*b*.

The bag 200 shown in FIGS. 6 and 7 is constructed in a manner similar to the bags 10, 100 discussed above and shown in FIGS. 1-5. In particular, the bag 200 is preferably formed from a single sheet of material, wherein the base wall 212, first panel 218 and second panel 220 are cut from the sheet of material. The first and second panels 218, 220 and then folded relative to the base wall 220 to allow the first end portions 224*a*, 224*b* and the second end portions 234*a*, 234*b* to be seamed to the base wall 212, and then to each other.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combinations described herein. Thus, the scope of the claims is not to be limited by the illustrated embodiments.

What is claimed is:

1. A deployable fluid collection bag comprising:

a base wall defining a pair of opposed end edges and a pair of opposed lateral portions extending between the pair of opposed end edges;

a first panel integrally coupled to the base wall adjacent a respective one of the pair of opposed lateral portions, the first panel including a first sidewall and a pair of first end portions integrally formed with the first sidewall and disposed on opposed ends of the first sidewall, the first sidewall including a first aperture to define a first handle, each first end portion defining a first base edge and a first end edge, each first base edge being coupled to a respective one of the pair of opposed end edges to form a fluid-tight seal between the base wall and the pair of first end portions; and a second panel integrally coupled to the base wall adjacent a respective one of the pair of opposed lateral portions, the second panel including a second sidewall and a pair of second end portions disposed on opposed ends of the second sidewall, the second sidewall including a second aperture to define a second handle, each second end portion defining a second base edge and a second end edge, each second base edge being coupled to a respective one of the pair of opposed end edges to form a fluid-tight seal between the base wall and the pair of second end portions, each second end edge being coupled to a respective first end edge to form a fluid tight seal between respective ones of the pair of first end portions and the pair of second end portions;

the pair of first end portions and the pair of second end portions collectively defining a pair of end walls, each end wall having an aperture formed therein to define a respective handle, wherein each aperture is collectively defined by the respective pair of end portions.

2. The deployable fluid collection bag of claim 1, wherein the fluid tight seal extending between respective ones of the pair of first end portions and the pair of second end portions extends along an axis that intersects the aperture formed within the respective end wall.

3. The deployable fluid collection bag of claim 1, wherein the length of each first base edge is substantially equal to the length of each second base edge.

4. The deployable fluid collection bag of claim 1, wherein the first panel and the second panel are configured to be independently and selectively moveable relative to the base between a collapsed position and a deployed position.

5. The deployable fluid collection bag of claim 1, wherein the first panel and the second panel are configured to be moveable relative to the base between a collapsed position and a deployed position, the first aperture being coaxially aligned with the second aperture when the first and second panels are moved to the deployed position.

6. The deployable fluid collection bag of claim 1, wherein the fluid collection bag is formed from a single sheet of material.

7. The deployable fluid collection bag of claim 6, wherein the material is plastic.

8. The deployable fluid collection bag of claim 1, wherein the base is formed of a continuous sheet of material.

* * * * *